US007048514B2

(12) United States Patent
Khomynets

(10) Patent No.: US 7,048,514 B2
(45) Date of Patent: May 23, 2006

(54) DOWNHOLE JET UNIT FOR TESTING AND COMPLETING WELLS

(76) Inventor: Zinoviy D Khomynets, d.33, ul. Vilshanetskaya, Tismenitsa, obl.Ivano-Frankovskaya (UA) 77400

( * ) Notice: Subject to any disclaimer, the term of this patent is extended or adjusted under 35 U.S.C. 154(b) by 251 days.

(21) Appl. No.: 10/467,517

(22) PCT Filed: Oct. 31, 2001

(86) PCT No.: PCT/RU01/00459

§ 371 (c)(1),
(2), (4) Date: Aug. 6, 2003

(87) PCT Pub. No.: WO02/066840

PCT Pub. Date: Aug. 29, 2002

(65) Prior Publication Data

US 2004/0067141 A1 Apr. 8, 2004

(30) Foreign Application Priority Data

Feb. 20, 2001 (RU) ..... 2001104495

(51) Int. Cl.
*F04F 5/22* (2006.01)

(52) U.S. Cl. ..... 417/167; 417/151; 417/176; 417/172; 417/76; 417/89; 166/106

(58) Field of Classification Search ..... 417/151, 417/176, 170, 172, 167, 76, 84, 89, 54; 166/106
See application file for complete search history.

(56) References Cited

U.S. PATENT DOCUMENTS 4,293,283 A 10/1981 Roeder ..... 417/172
4,310,288 A * 1/1982 Erickson ..... 417/54
4,518,036 A * 5/1985 Lefebvre et al. ..... 166/105
4,603,735 A * 8/1986 Black ..... 166/68
4,744,730 A 5/1988 Roeder ..... 417/172
4,790,376 A * 12/1988 Weeks ..... 166/68

(Continued)

FOREIGN PATENT DOCUMENTS

RU 2059891 C1 * 5/1996

(Continued)

*Primary Examiner*—Charles G. Freay
*Assistant Examiner*—Emmanuel Sayoc
(74) *Attorney, Agent, or Firm*—Dellett & Walters

(57) ABSTRACT

The invention relates to pumping engineering, mainly to downhole jet production units. The inventive downhole jet unit comprises a packer, a pipe column and a jet pump. An active nozzle and a mixing chamber are axially arranged in the body of the jet pump, and a pass channel provided with a mounting face for a sealing assembly with an axial channel is embodied therein. Said unit is also provided with an irradiator and a receiver transformer of physical fields. Said receiver transformer is arranged on the side of entry of a liquid pumped from the well into the jet pump and mounted on a cable passing through the axial channel of the sealing assembly. The output of the jet pump is connected to the pipe column above the sealing assembly. The input of a channel for feeding the pumped out medium of the jet pump is connected to a space around the pipe column below the sealing assembly. The input of a channel supplying a working medium to the active nozzle is connected to a space around the pipe column. A number of channels for feeding the pumped out medium are embodied in the body of the jet pump. The invention makes it possible to optimise dimensions of various elements of the unit, thereby increasing the operating reliability of the downhole jet unit.

1 Claim, 3 Drawing Sheets

U.S. PATENT DOCUMENTS

| | | | | |
|---|---|---|---|---|
| 4,988,389 | A * | 1/1991 | Adamache et al. | 166/302 |
| 5,000,264 | A * | 3/1991 | Snider | 166/372 |
| 6,026,904 | A * | 2/2000 | Burd et al. | 166/313 |
| 6,328,103 | B1 * | 12/2001 | Pahmiyer et al. | 166/250.17 |
| 6,364,625 | B1 * | 4/2002 | Sertier | 417/182 |

FOREIGN PATENT DOCUMENTS

| | | |
|---|---|---|
| RU | 2059891 | 10/1996 |
| RU | 2106540 | 10/1998 |
| RU | 2121610 | 10/1998 |

* cited by examiner

DOWNHOLE JET UNIT FOR TESTING AND COMPLETING WELLS

FIELD OF INVENTION

This invention relates to the field of pumping engineering, mainly to downhole jet units for oil production.

PRIOR ART

Known in the art is a downhole jet unit comprising a jet pump installed on the production string in the well and a geophysical instrument placed in the production string below the said jet pump (RU 2059891 C1).

The said jet pumping unit enables to pump different extracted media, e.g., oil, out of the well with the simultaneous treatment of the extracted medium and the well formation zone, but the said unit provides for supply of a working medium to the nozzle of the jet unit over the string, which in some cases narrows the field of application of the said unit.

The closest, as to its technical essence and the achievable result, to this invention is a down-hole jet unit comprising a packer, a piping string and a jet pump, the body of the said pump comprising an active nozzle and a mixing chamber axially arranged therein, and a pass channel being made with a mounting face for installing a sealing assembly with an axial channel, the said downhole jet unit is provided with an irradiator and receiver-transformer of physical fields, which is arranged on the jet pump side for entry of the medium pumped out of the well and is installed on the cable put through the axial channel of the sealing assembly, the output side of the jet pump is connected to the piping string above the sealing assembly, the jet pump side for entry of the pumped out medium is connected to the piping string below the sealing assembly, and the input side of the channel for supplying the working medium to the active nozzle is connected to the space surrounding the lifting pipe string, and several channels for supplying the pumped out medium are made in the body of the jet pump (RU 2106540 C1).

The said downhole jet unit enables to perform various production operations in the well below the jet pump installation level by, inter alia, reducing a pressure difference both above and below the sealing assembly. However, the said downhole jet unit does not enable to utilize its possibilities in full due to non-optimal relationships between dimensions of various components of the construction of the downhole jet unit.

DISCLOSURE OF INVENTION

The objective of this invention is to optimize the dimensions of various components of the construction of the downhole jet unit and, owing to it, to raise the reliability of its operation.

The stated objective is achieved owing to the fact that the downhole jet unit comprises a packer, a piping string and a jet pump, in the body of which an active nozzle and a mixing chamber are axially arranged, and a pass channel is made with a mounting face for installing a sealing assembly having an axial channel, the said unit is provided with an irradiator and receiver-transformer of physical fields, which is arranged at the jet pump side for entry of the medium pumped out of the well and is mounted on the cable put through the axial channel of the sealing assembly, the jet pump output side is connected to the piping string above the sealing assembly, the input side of the channel for supplying the pumped out medium of the jet pump is connected to the piping string below the sealing assembly, and the input side of the channel for supplying the working medium to the active nozzle is connected to the space surrounding the lifting pipe string, and several channels for supplying the pumped out medium are made in the body of the jet pump, wherein, according to this invention, the diameter of each channel for supplying the pumped out medium is not less than the inner diameter of the nozzle output cross-section, the diameter of the pass channel in the area of the mounting face is, at least, 1 mm less than its diameter above the mounting face, the diameter of the axial channel in the sealing assembly is, at least, 0.01 mm larger than the diameter of the cable, the diameter of the sealing assembly is, at least, 2 mm less that the diameter of the inner hole of the tubes, the diameter of the irradiator and receiver-transformer of physical fields is, at least, 2 mm less that the diameter of the pass channel in the area of the mounting face, the diameter of the pass channel in the packer is, at least, 2 mm larger than the diameter of the irradiator and receiver-transformer of physical fields, and in the lower portions of the channels for supplying the pumped out medium positions are made for installing check valves or other devices.

The analysis of the operation of the downhole jet unit has shown that the its reliability may be increased by making various components of the construction of the unit according to strictly defined dimensions. It has been found out, in particular, that in a case where several channels for supplying the pumped out medium are made, the diameter of those channels may not be taken arbitrarily. It is due to the fact that a too large diameter of the channels results in a reduction in the strength of the unit, but a too small diameter of those channels results in lowering the capacity of the jet pump. Taking into account that the jet pump capacity mainly depends on the flow rate of the working medium passing through the active nozzle, the diameter of the output cross section of the nozzle has been selected as the typical dimension. It has been found out in this connection that it is not advisable to make the diameter of the channels for supplying the pumped out medium less that the inner diameter of the output cross section of the active nozzle. As to the upper limit, it should be defined by the strength characteristics of the jet pump construction, and, first of all, by those of the jet pump body. In each particular case this value is to be determined individually. In the course of the unit operation studies of different well modes are conducted. One has to install and remove the sealing assembly, and move, in the process of operation, the irradiator and receiver-transformer of physical fields along the well. It has been determined that it is not advisable to make the diameter of the pass channel in the area of the mounting face of the sealing assembly that it would be less than 1 mm less than the diameter of the pass channel above the mounting face, and the diameter of the sealing assembly itself should be made at least 2 mm less than the inner diameter of the piping string. In the result, possible sticking of the sealing assembly in the piping string during installation or removal of the sealing assembly is precluded, and the reliable installation of the sealing assembly onto the mounting face is ensured. It has already been said that in the process of the unit operation it is necessary to move the irradiator and receiver-transformer of physical fields along the well and, at the same time, minimize the medium flow through the axial channel of the sealing assembly. It has been achieved by making the irradiator and receiver-transformer of physical fields at least 2 mm less than the diameter of the packer pass channel and the diameter of the pass channel in the area of the sealing assembly mounting face, and the diameter of the axial channel in the sealing assembly should be made that it would be at least 0.01 mm larger than the diameter of the cable, on which the irradiator and receiver-transformer of physical fields is installed. In some cases, e.g., when carrying out repair and restoration works at the well, a need arises to isolate the well after stopping the jet pump. In such a case the most convenient place for installing check valves is the lower portion of the channels for supplying the pumped out medium. For this purpose the lower portions of the said channels are provided with positions for installing check valves or other devices necessary for ensuring the operation of the unit.

Thus, the objective of the invention—to optimize the dimensions of various components of the construction of the unit and, owing to it, raise the reliability of operation of the downhole jet unit—has been achieved.

BEST EMBODIMENT OF THE INVENTION

Figure 1:
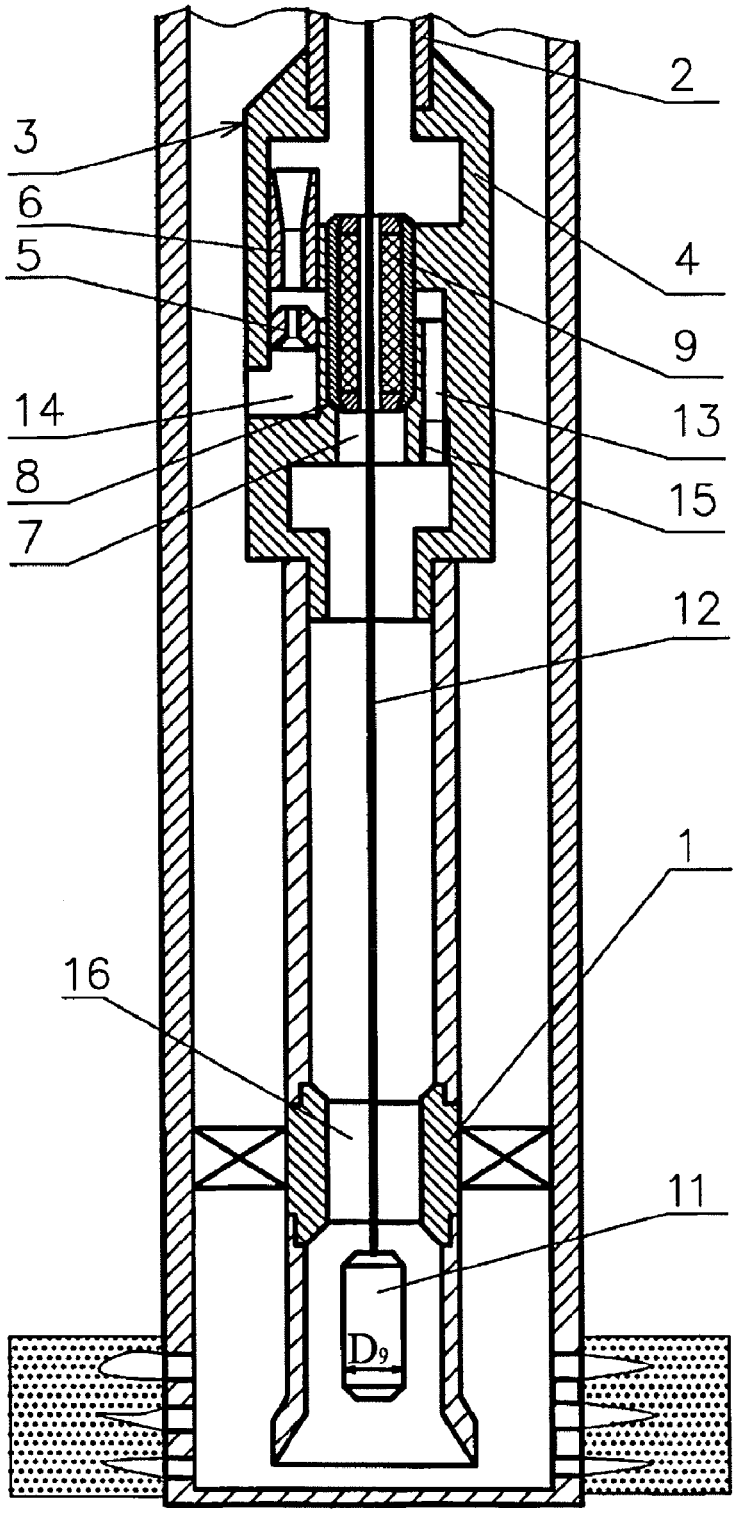
FIG. 1 represents a longitudinal section of the disclosed downhole jet unit.
Figure 2:
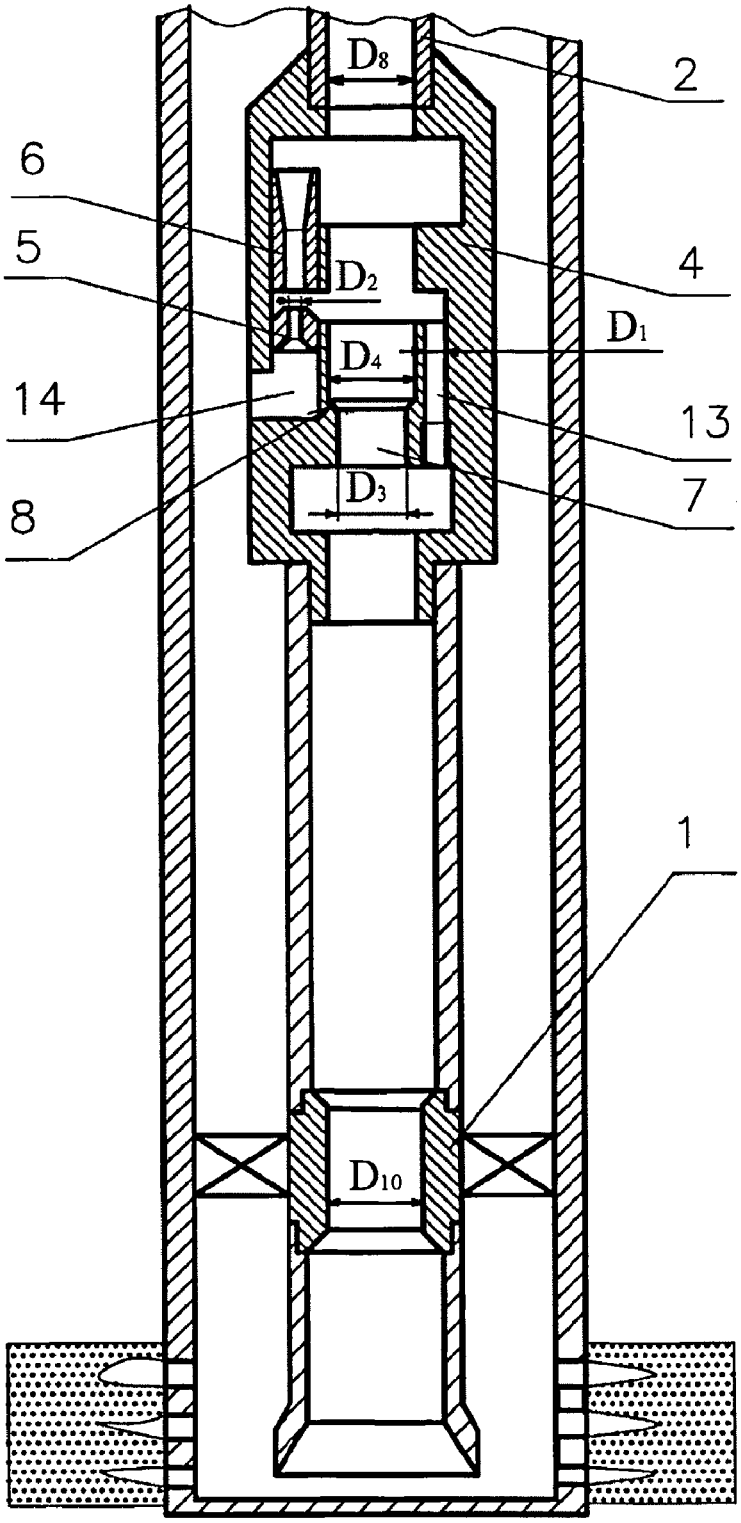
FIG. 2 represents a longitudinal section of the unit without the sealing assembly and the irradiator and receiver-transformer of physical fields.
Figure 3:
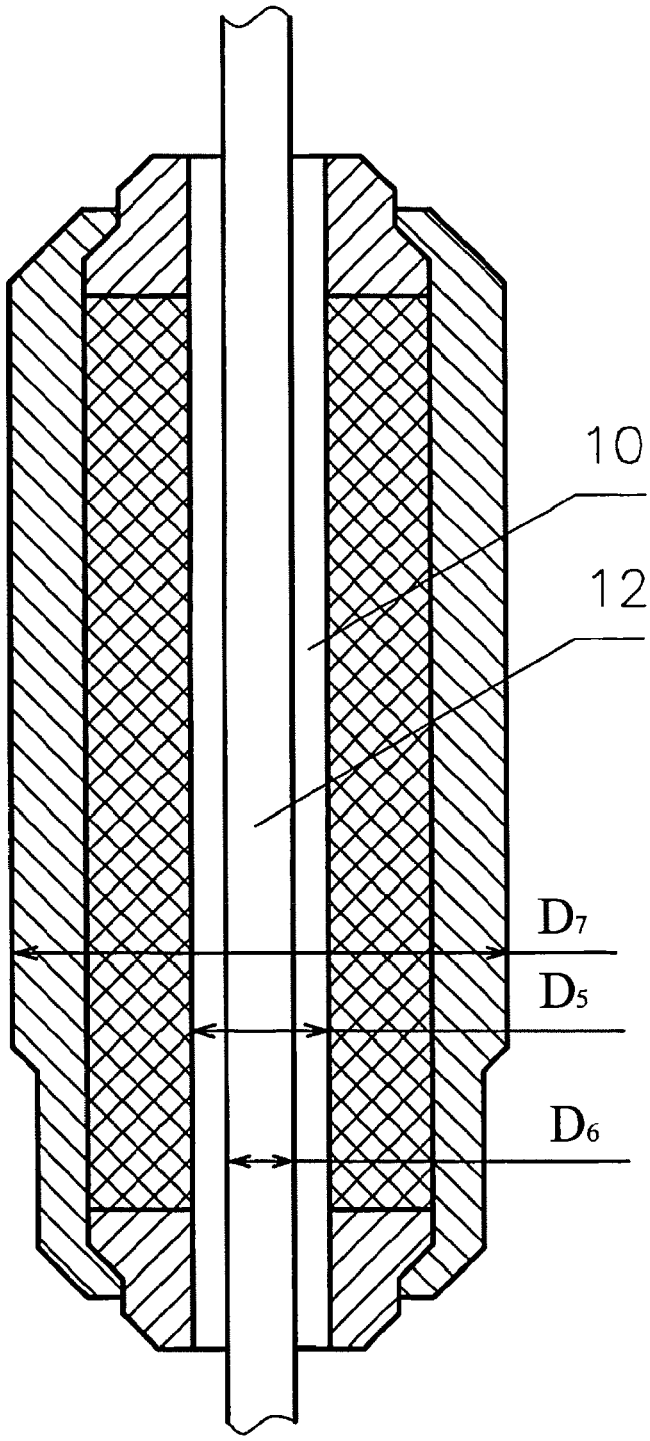
FIG. 3 represents a longitudinal section of the sealing assembly.

The downhole jet unit comprises a packer 1, a piping string 2, and a jet pump 3, in the body 4 of which an active nozzle 5 and a mixing chamber 6 are axially arranged, and a pass channel 7 is made with a mounting face 8 for installing a sealing assembly 9 having an axial channel 10. The unit is also provided with an irradiator and receiver-transformer 11 of physical fields, which is arranged at the side of the jet pump 3 for entry of the medium pumped out of the well and is mounted on the cable 12 put through the axial channel 10 of the sealing assembly 9. The output side of the jet pump 3 is connected to the piping string 2 above the sealing assembly 9. The input side of the channel 13 for supplying the pumped out medium of the jet pump 3 is connected to the piping string 2 below the sealing assembly 9, and the input side of the channel 14 for supplying the working medium to the active nozzle 5 is connected to the space surrounding the lifting pipe string 2, and several channels 13 for supplying the pumped out medium are made in the body 4 of the jet pump 3. The diameter $D_1$ of each channel 13 for supplying the pumped out medium is not less that the inner diameter $D_2$ of the output cross-section of the nozzle 5. The diameter $D_3$ of the pass channel 7 in the area of the mounting face 8 is, at least, 1 mm less than its diameter $D_4$ above the mounting face 8. The diameter $D_5$ of the axial channel 10 in the sealing assembly 9 is, at least, 0.01 mm larger than the diameter $D_6$ of the cable 12. The diameter $D_7$ of the sealing assembly 9 is, at least, 2 mm less that the diameter $D_8$ of the inner hole of the tubes 2. The diameter $D_9$ of the irradiator and receiver-transformer 11 of physical fields is, at least, 2 mm less that the diameter $D_3$ of the pass channel 7 in the area of the mounting face 8. The diameter $D_{10}$ of the pass channel 16 in the packer 1 is, at least, 2 mm larger than the diameter $D_9$ of the irradiator and receiver-transformer of physical fields, and in the lower portions of the channels 13 for supplying the pumped out medium positions 15 (e.g., threaded sections) are made for installing check valves (not shown) or other devices.

The jet pump 3 and the packer 1 on the piping string 2 are lowered into the well and are placed above the producing formation. The packer 1 is brought into the operating position, thus isolating the borehole clearance. The sealing assembly 9 and the irradiator and receiver-transformer 11 of physical fields are lowered on the cable 12. Into the borehole clearance around the piping string 2 a working medium, e.g., water, salt solution, oil, etc., is pumped. The working medium comes from the borehole clearance through the channel 14 into the active nozzle 5 of the jet pump 3. Within a few seconds after the pumping of the working medium through the active nozzle 5 a stable jet is formed at the nozzle output, which, going out of the nozzle 5, entrains the surrounding medium into the jet pump, which results in a pressure reduction first in the channels 13 for supplying the pumped out medium and then in the under-packer space of the well, thus creating pressure drawdown onto the producing formation. The amount, for which the pressure is lowered, depends on the rate, at which the working medium goes through the active nozzle 5, which rate, in its turn, depends on the pressure value of the working medium discharged into the borehole clearance above the packer 1. In the result, the formation medium comes over the piping string 2 and through the channels 13 into the jet pump 3, where it is mixed with the working medium, and the mixture of the media, owing to the energy of the working medium comes over the piping string 2 out of the well and on the surface. During the pumping out of the formation medium the parameters of the pumped out formation medium are monitored, and it is influenced with the irradiator and receiver-transformer 11 of physical fields. Depending on a particular task it is possible to move the irradiator and receiver-transformer 11 of physical fields along the well.

INDUSTRIAL APPLICABILITY

This invention may be applied when testing, completing and operating oil or gas condensate wells as well as when conducting workover jobs thereon.

What is claimed is:

1. The downhole jet unit comprising a packer, a piping string and a jet pump, said jet pump having a body and in said body of which an active nozzle and a mixing chamber are axially arranged, and a pass channel is provided, adjacent a mounting face for installing a sealing assembly having an axial channel, said unit being provided with an irradiator and receiver-transformer of physical fields, which is arranged at the jet pump side for entry of the medium pumped out of a well and is mounted on the cable put through the axial channel of the sealing assembly, the jet pump output side is connected to the piping string above the sealing assembly, the input side of a channel for supplying the pumped out medium of the jet pump is connected to the piping string below the sealing assembly, and the input side of a channel for supplying the working medium to the active nozzle is connected to a space surrounding the lifting pipe string, and several channels for supplying the pumped out medium are formed in the body of the jet pump, wherein the diameter of the channel for supplying the pumped out medium is not less than the inner diameter of the nozzle output cross-section, the diameter of the pass channel is at least 1 mm less in the area of the mounting face than its diameter above the mounting face, the diameter of the axial channel in the sealing assembly is, at least, 0.01 mm larger than the diameter of the cable, the diameter of the sealing assembly is, at least, 2 mm less that the diameter of the inner hole of the piping string, the diameter of the irradiator and receiver-transformer of physical fields is, at least, 2 mm less that the diameter of the pass channel in the area of the mounting face, the diameter of the pass channel in the packer is, at least, 2 mm larger than the diameter of the irradiator and receiver-transformer of physical fields, and in the lower portions of the channel for supplying the pumped out medium, positions are provided for installing check valves or other devices.

* * * * *